US010811243B2

(12) United States Patent
Peterson et al.

(10) Patent No.: US 10,811,243 B2
(45) Date of Patent: Oct. 20, 2020

(54) ION SUPPLY SYSTEM AND METHOD TO CONTROL AN ION SUPPLY SYSTEM

(71) Applicant: Thermo Fisher Scientific (Bremen) GmbH, Bremen (DE)

(72) Inventors: Amelia Corinne Peterson, Bremen (DE); Denis Chernyshev, Bremen (DE); Jan-Peter Hauschild, Weyhe (DE); Erik Couzijn, Bremen (DE)

(73) Assignee: Thermo Fisher Scientific (Bremen) GMBH, Bremen (DE)

( * ) Notice: Subject to any disclaimer, the term of this patent is extended or adjusted under 35 U.S.C. 154(b) by 0 days.

(21) Appl. No.: 16/226,417

(22) Filed: Dec. 19, 2018

(65) Prior Publication Data

US 2019/0198308 A1 Jun. 27, 2019

(30) Foreign Application Priority Data

Dec. 21, 2017 (GB) ..... 1721678.9

(51) Int. Cl.

| | |
|---|---|
| ***H01J 49/16*** | (2006.01) |
| ***H01J 49/06*** | (2006.01) |
| ***H01J 49/04*** | (2006.01) |
| ***H01J 49/02*** | (2006.01) |

(52) U.S. Cl.

CPC ..... *H01J 49/165* (2013.01); *H01J 49/022* (2013.01); *H01J 49/0404* (2013.01); *H01J 49/062* (2013.01); *H01J 49/066* (2013.01)

(58) Field of Classification Search

CPC ..... H01J 49/0027; H01J 49/0031; H01J 49/0404; H01J 49/066; H01J 49/165

See application file for complete search history.

(56) References Cited

U.S. PATENT DOCUMENTS 6,107,628 A * 8/2000 Smith ..... H01J 49/066 250/292
6,462,338 B1 * 10/2002 Inatsugu ..... H01J 49/065 250/292
6,583,408 B2 * 6/2003 Smith ..... H01J 49/0404 250/288

(Continued)

FOREIGN PATENT DOCUMENTS

EP 1465234 B1 11/2016

OTHER PUBLICATIONS

Julian et al., "Ion Funnels for the Masses: Experiments and Simulations with a Simplified Ion Funnel", J. Amer. Soc. Mass Spec., (2005), vol. 16, pp. 1708-1712.

(Continued)

*Primary Examiner* — David E Smith

(57) ABSTRACT

Disclosed herein is an ion supply system, having an ion source emitting ions into a fore vacuum chamber, an ion transport device having stacked electrodes arranged in the fore vacuum chamber, a control system supplying an oscillatory voltage to the electrodes of the ion transport device and a vacuum chamber, arranged downstream from the ion transport device. A vacuum gauge is arranged in the vacuum chamber. The pressure signal of the vacuum gauge is supplied to the control system supplying the oscillatory voltage to electrodes of the ion transport device. The control system adjusts the amplitude of the oscillatory voltage in accordance with the pressure signal.

10 Claims, 6 Drawing Sheets

(56) References Cited

U.S. PATENT DOCUMENTS

| | | | | |
|---|---|---|---|---|
| 7,064,321 | B2 * | 6/2006 | Franzen | H01J 49/066 250/281 |
| 2009/0045062 | A1 | 2/2009 | Senko et al. | |
| 2012/0112061 | A1 | 5/2012 | Morokuma et al. | |
| 2014/0217280 | A1 | 8/2014 | Sugawara | |
| 2016/0322209 | A1 | 11/2016 | Wouters et al. | |

OTHER PUBLICATIONS

Kelly et al., "The Ion Funnel: Theory, Implementations and Applications", Mass Spectrometry Reviews, 2010, 29, pp. 294-312.

* cited by examiner

Table 1

| Ionisation method | Ione flow rate [μl/min] | Source gas temperature [°C] | Pressure measured by the vacuum gauge 200 [mbar] |
|---|---|---|---|
| Nanoelectrospray ionisation (nESI) | 0.5 | 0 | 0.20 |
| Heated electrospray ionisation (HESI) | 5.0 | 0 | 0.16 |
| Heated electrospray ionisation (HESI) | 50.0 | 0 | 0.16 |
| Heated electrospray ionisation (HESI) | 100.0 | 300 | 0.12 |
| Heated electrospray ionisation (HESI) | 200.0 | 300 | 0.12 |

FIG. 6

ION SUPPLY SYSTEM AND METHOD TO CONTROL AN ION SUPPLY SYSTEM

TECHNICAL FIELD OF THE INVENTION

The invention belongs to an ion supply system, which is supplying ions from an ion source to an ion analyzing system. Further the invention is related to a method to control an ion supply system.

BACKGROUND OF THE INVENTION

To analyze ions in an ion analyzing system, ions have to be generated in an ion source and then supplied to the ion analyzing system by an ion supply system. An ion analyzing system is a system, in which the properties of ions are investigated, after they have been supplied to the system. The investigated properties may be for example the mass distribution, the mass, the structure of the ions, in particular they are large ionized molecules like proteins and peptides. The ion analyzing system may comprise additional to the analyzing unit comprise for example ion optics, ion filters, collision cells, ion trapping devices and more. The analyzing unit may be for example a mass analyzer of a mass spectrometer. Very often the ion analyzing system is operating in a vacuum and the ions are emitted from an ion source, in which the pressure is in the range of 10 mbar up to 2,000 mbar.

Therefore, ion supply systems are known, in which ions are generated in an ion source and then transferred to an ion analysing system operating in a vacuum. An ion analysing instrument is then comprising the ion supply system and the ion analysing system.

A fundamental challenge is then the efficient transport of ions in the ion supply system from the ion source to the ion analyzing system, which may comprise for example a mass analyzer, particularly through atmospheric or low vacuum regions where ion motion is substantially influenced by interaction with background gas molecules. Therefore, the ion supply system is comprising a fore vacuum chamber. While electrostatic optics are commonly employed in vacuum for ion transport and ion focusing, it is known that the effectiveness of such devices is limited due to the large numbers of collisions experienced by the ions in atmospheric or low vacuum regions. Consequently, ion transport losses through the low vacuum regions in the ion supply system tend to be high, which has a significant adverse impact on the ion analyzing instrument's overall sensitivity.

Various approaches have been proposed, in particular in the mass spectrometry art, for improving ion transport efficiency in low vacuum regions.

In general, all approaches are using an ion transport device with stacked electrodes, which are arranged in the fore vacuum chamber of the ion supply system for ion transportation and ion focusing.

One approach is embodied by the ion funnel device as an ion transport device described in U.S. Pat. No. 6,107,628 to Smith et al, which is incorporated by reference to this description. Roughly described, the ion funnel device consists of a multitude of closely longitudinally spaced ring electrodes having apertures that decrease in size from the entrance of the device to its exit. The electrodes are electrically isolated from each other, and radio-frequency (RF) voltages are applied to the electrodes in a prescribed phase relationship to radially confine the ions to the interior of the device. The relatively large aperture size at the device entrance provides for a large ion acceptance area, and the progressively reduced aperture size creates a "tapered" RF field having a field-free zone that decreases in diameter along the direction of ion travel, thereby focusing ions to a narrow beam which may then be passed through the aperture of a skimmer or other electrostatic lens without incurring a large degree of ion losses. Refinements to and variations on the ion funnel device are described in (for example) U.S. Pat. No. 6,583,408 to Smith et al., U.S. Pat. No. 7,064,321 to Franzen, European patent application EP 1 465 234 and Julian et al., "Ion Funnels for the Masses: Experiments and Simulations with a Simplified Ion Funnel", J. Amer. Soc. Mass Spec., vol. 16, pp. 1708-1712 (2005).

Another approach is described in the US patent application US 2009/0045062 A1, which is incorporated by reference to this description. In this embodiment, an ion transport device is comprising a plurality of longitudinally spaced apart electrodes defining an ion channel along which ions are transported, each of the plurality of electrodes being adapted with an aperture through which ions may travel and a oscillatory voltage is applied to at least a portion of the plurality of electrodes, wherein at least one of (i) the spacing between adjacent electrodes, and (ii) the amplitude of the applied oscillatory voltages increases in the direction of ion travel.

A further approach is described in the U.S. Pat. No. 6,462,338 B1, which is incorporated by reference to this description. In this embodiment of an ion transport device is also comprising stacked lens electrodes aligned longitudinally and defining an ion channel. To each of the electrodes an oscillating voltage is applied.

A detailed overview about such approaches is also given in Kelly et al, "The ion funnel: Theory, implementations and applications" Mass Spectrometry Reviews, 2010, 29, 294-312, which is incorporated by reference in this description.

In all these approaches an oscillatory voltage is supplied to the stacked electrodes of the ion transport devices. In particular, the voltage is supplied to adjacent electrodes with opposite polarity (i.e., in a 180° out-of-phase relation).

All ion transport devices with stacked electrodes are limited to transmit only ions of mass to charge ratios m/z in a specific mass to charge window according to the oscillating voltage applied to their electrodes. So, for every experiment an appropriate oscillating voltage has to be applied to the electrodes.

According to this, ions of a specific mass to charge to ratio are only transmitted in a specific range of the amplitude of the oscillating voltage applied to the electrodes of the ion transport device.

It is known that transmission of ions in an ion supply system depends on the experimental conditions and that accordingly the specific range of the amplitude of the oscillating voltage, in which ions are transmitted will change.

It is the object of the invention to improve the ion transmission of ion transport devices, having stacked electrodes. In particular, the influence of any experimental change of the ion source supplying the ions to the ion transport device on the ion transmission shall be reduced, including the type of the source, the source settings, sample flow rate and sample temperature. Also, the influence of the conditions of the fore vacuum chamber, in which the ion transport device is arranged, on the ion transmission shall be reduced. Further the influence of a slowly clogging of the transfer tube shall be reduced. Moreover, the influence of the conditions in the ion inlet device, including its orientation, shape and temperature on the ion transmission shall be reduced.

SUMMARY OF THE INVENTION

The above mentioned objects are solved by an ion supply system, which is comprising an ion source emitting ions into a fore vacuum chamber, an ion transport device having stacked electrodes arranged in the fore vacuum chamber, a control system supplying a oscillatory voltage to the electrodes of the ion transport device and a vacuum chamber, arranged downstream from the ion transport device. The fore vacuum chamber and the vacuum chamber, arranged downstream from the ion transport device are neighbouring vacuum chambers, separated by a wall and connected by an aperture, e.g. of an optical lens. In the vacuum chamber, arranged downstream from the ion transport device is a vacuum gauge is arranged. The pressure signal of the vacuum gauge is supplied to the control system supplying the oscillatory voltage to electrodes of the ion transport device. The control system is supplying the oscillatory voltage to the electrodes of the ion transport device with an amplitude, which is correlated to the pressure signal of the vacuum gauge 200.

The vacuum gauge provided in the vacuum chamber, arranged downstream from the ion transport device, can be any kind of instrument, which is able to detect or measure the pressure in the vacuum chamber, like a ionization gauge, a Pirani gauge, a hot-cathode ionization gauge, a membrane gauge, or a Penning gauge.

In the fore vacuum chamber, in which the ion transport device is arranged, a fore vacuum of a typical fore vacuum pressure is present. Typically, only a fore vacuum pump is used to achieve this pressure stage. In the fore vacuum chamber ions of an ion source are emitted. In particular, the ions are emitted from atmospheric pressure or elevated pressure (which is higher than atmospheric pressure) existing in the ion source. Further ions can be emitted from an ion source, in which the pressure is in the range of 10 mbar up to 10,000 mbar, preferably in the range of 500 mbar up to 2,000 mbar and in particular preferably in the range of 800 mbar up to 1,200 mbar. Therefore, it is not possible to supply the ions directly into a vacuum chamber. Typical pressure values of the fore vacuum are between 0.1 millibar and 50 millibar, preferably between 0.5 mbar and 10 mbar and particular preferably between 1 mbar and 5 mbar.

Various ionization techniques known to a person skilled in the art can be used in the ion source of the ion supply system, in particular all kinds the electrospray ionization, chemical ionization, photo-ionization, and laser desorption or matrix-assisted laser desorption/ionization (MALDI).

Preferably the ion source is emitting ions into a fore vacuum chamber through an ion inlet device, like an ion transfer tube or an array of ion transfer tubes. Details of embodiments of such an ion transfer tube are described below. The ion inlet device can induce a jet stream of ions into the ion transport device, which can reach preferably in the middle of the ion transport device in the direction of the ion channel (which is the flight direction of the ions) and particular preferably can reach at least nearly up to the exit of the ion transport device. So there can be a jet stream in at least 50% of the length of ion channel of the ion transport device, preferably in at least 80% of the length of ion channel of the ion transport device and particular preferably in at least 90% of the length of ion channel of the ion transport device.

The shape of the stacked electrodes can be equal or different for each electrode or different for groups of electrodes. Preferably, they have an aperture forming the ion channel, which might be preferably circular, elliptical or oval. Each stacked electrode may consist of one part or of several parts, to which preferably the same oscillating voltage is applied. In particular, all electrodes may have the shape of a ring. The diameters of the electrodes, in particular of the ring-shaped electrodes, and the distance between the electrodes may be constant for all electrodes or vary along the ion channel.

The pressure in the vacuum chamber, arranged downstream from the ion transport device, is typically in a range of 0.05 mbar up to 0.5 mbar, preferably in a range of 0.08 mbar up to 0.3 mbar and particularly preferably in a range of 0.10 mbar up to 0.25 mbar.

The control system supplying the oscillatory voltage, typically an RF voltage, to the electrodes of the ion transport device, can also supply a DC voltage to at least one or some of the electrodes, in particular to accelerate the ions in the ion transport device in the direction of its exit. The control system may further control a whole ion analysing instrument, e.g. a mass spectrometer.

In a preferred embodiment the oscillatory voltage supplied by the control system to the electrodes of the ion transport device will be changed when a change of pressure is detected by the vacuum gauge.

In a preferred embodiment the control system is changing the oscillatory voltage supplied by the control system to the electrodes of the ion transport device according to a calibration curve.

In a preferred embodiment the control system is supplying an oscillatory voltage with am amplitude according to the pressure signal of the vacuum gauge.

In a preferred embodiment the vacuum gauge is arranged in vacuum chamber arranged downstream from the ion transport device closely to device exit of the ion transport device.

In a preferred embodiment the vacuum gauge is arranged in the vacuum chamber arranged downstream from the ion transport device closely to lens aperture of the extraction lens downstream from the ion transport device, which is arranged between the fore vacuum chamber and the vacuum chamber.

In a preferred embodiment the spacing of adjacent electrodes 135 of the ion travel device is increased in the direction of the ion travel.

In a preferred embodiment the electrodes of the ion transport device have apertures that decrease in size from the entrance of the ion transport device to the exit of the ion transport device.

The above mentioned objects are also solved by ion supply system, which is comprising an ion source emitting ions into a fore vacuum chamber, an ion transport device having stacked electrodes arranged in the fore vacuum chamber, a control system supplying a oscillatory voltage to the electrodes of the ion transport device and a vacuum chamber, arranged downstream from the ion transport device. The fore vacuum chamber and the vacuum chamber, arranged downstream from the ion transport device are neighbouring vacuum chambers, separated by a wall and connected by an aperture, e.g. of an optical lens. In the fore vacuum chamber is a vacuum gauge is arranged. The pressure signal of the vacuum gauge is supplied to the control system supplying the oscillatory voltage to electrodes of the ion transport device. The control system is supplying the oscillatory voltage to the electrodes of the ion transport device with an amplitude, which is correlated to the pressure signal of the vacuum gauge 200.

The object of the invention is also solved by a method for supplying ions into a vacuum system, comprising the steps:

(i) creating ions in an ion source
(ii) emitting the ions into an ion channel of an ion transport device having stacked electrodes, which is arranged in a fore vacuum chamber
(iii) applying a oscillation voltage to the electrodes of the ion transport device, so that the ions travelling through the ion transport device are radial confined to a aperture arranged behind the ion transport device, through which they travel into a vacuum chamber
(iv) measuring with a vacuum gauge the pressure in the vacuum chamber downstream of the ion transport device
(v) submitting a pressure signal of the vacuum gauge to a control unit, controlling at least the oscillation voltage applied to the electrodes of the ion transport device
wherein the control unit is applying a oscillation voltage to the electrodes, which is correlated to the pressure measured in the vacuum chamber.

The object of the invention is also solved by a method for supplying ions into a vacuum system, comprising the steps:
(i) creating ions in an ion source
(ii) emitting the ions into an ion channel of an ion transport device having stacked electrodes, which is arranged in a fore vacuum chamber
(iii) applying a oscillation voltage to the electrodes of the ion transport device, so that the ions travelling through the ion transport device are radial confined to a aperture arranged behind the ion transport device, through which they travel into a vacuum chamber
(iv) measuring with a vacuum gauge the pressure in the fore vacuum chamber
(v) submitting a pressure signal of the vacuum gauge to a control unit, controlling at least the oscillation voltage applied to the electrodes of the ion transport device
wherein the control unit is applying a oscillation voltage to the electrodes, which is correlated to the pressure measured in the vacuum chamber.

BRIEF DESCRIPTION OF THE DRAWING

FIG. 6 shows the experimental conditions of the measurements of FIG. 3.

DETAILED DESCRIPTION OF PREFERRED EMBODIMENTS

Figure 1:
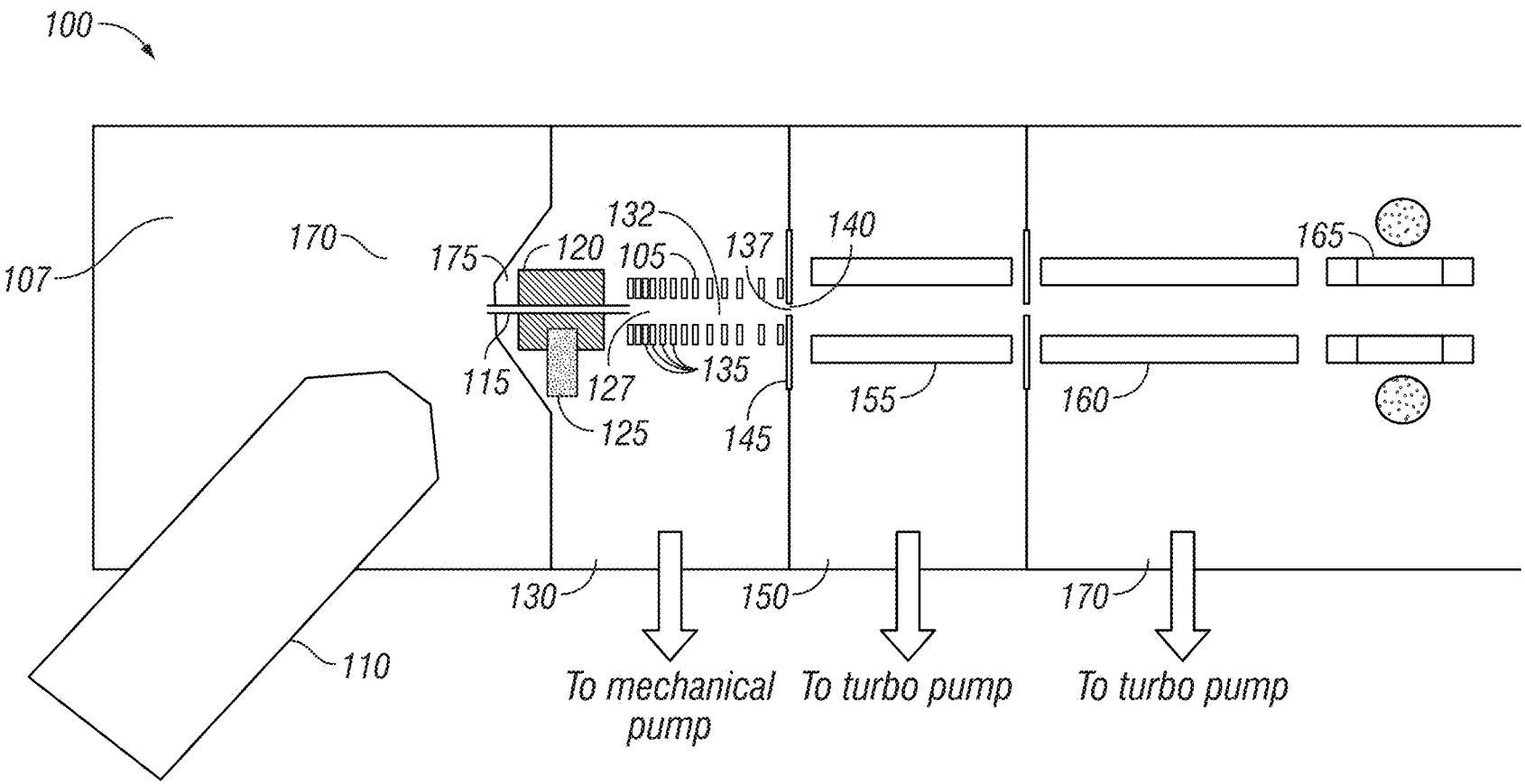
FIG. 1 shows a mass spectrometer with an ion supply system according to the prior art.

FIG. 1 is a schematic depiction of a mass spectrometer 100 incorporating an ion transport device 105 constructed known from the prior art, e.g. from US 2009/0045062, which is hereby incorporated to the description in total by reference. Analyte ions may be formed by electrospraying a sample solution into an ionization chamber 107 via an electrospray probe 110. For an ion source that utilizes the electrospray technique, ionization chamber 107 will generally be maintained at or near atmospheric pressure. The analyte ions, together with background gas and partially desolvated droplets, flow into the inlet end of a conventional ion transfer tube 115 (e.g., a narrow-bore capillary tube) and traverse the length of the tube under the influence of a pressure gradient. In order to increase ion throughput from ionization chamber 107, multiple ion flow channels may be provided by substituting multiple capillaries or a divided flow path ion transfer tube for the single channel ion transfer tube depicted herein. Analyte ion transfer tube 115 is preferably held in good thermal contact with a block 120 that is heatable by cartridge heater 125. As is known in the art, heating of the ion/gas stream passing through ion transfer tube 115 assists in the evaporation of residual solvent and increases the number of analyte ions available for measurement. The analyte ions emerge from the outlet end of ion transfer tube 115, which opens to an entrance 127 of the ion transport device 105 located within fore vacuum chamber 130. As indicated by the arrow, chamber 130 is evacuated to a low vacuum pressure by a mechanical pump or equivalent. Under typical operating conditions, the pressure within fore vacuum chamber will be in the range of 1-5 millibar, but it is believed that an ion transport device according to embodiments of the present invention may be successfully operated over a broad range of low vacuum pressures, e.g., between 0.1 millibar and 50 millibar.

It should be understood that the electrospray ionization source depicted and described herein is presented by way of an illustrative example, and that the ion transport device of the present invention should not be construed as being limited to use with an electrospray or other specific type of ionization source. Other ionization techniques that may be substituted for (or used in addition to) the electrospray source includes chemical ionization, photo-ionization, and laser desorption or matrix-assisted laser desorption/ionization (MALDI).

The analyte ions exit the outlet end of ion transfer tube 115 as a free jet expansion and travel through an ion channel 132 defined within the interior of ion transport device 105. As will be discussed in further detail below, radial confinement and focusing of ions within ion channel 132 are achieved by application of oscillatory voltages to apertured electrodes 135 of ion transport device 105. As is further discussed below, transport of ions along ion channel 132 to device exit 137 may be facilitated by generating a longitudinal DC field and/or by tailoring the flow of the background gas in which the ions are entrained. Ions leave ion transport device 105 as a narrowly focused beam and are directed through aperture 140 of extraction lens 145 into the vacuum chamber 150. The ions pass thereafter through ion guides 155 and 160 and are delivered to a mass analyzer 165 (which, as depicted, may take the form of a conventional two-dimensional quadrupole ion trap) located within chamber 170. Chambers 150 and 170 may be evacuated to relatively low pressures by means of connection to ports of a turbo pump, as indicated by the arrows. While ion transport device 105 is depicted as occupying a single chamber, alternative implementations may utilize an ion transport device that bridges two or more chambers or regions of successively reduced pressures.

The ion transport device shown in FIG. 1 shows one embodiment of an ion transport device which can be used in the invention as described below. The shown ion transport device 105 is formed from a plurality of generally planar electrodes 135 arranged in longitudinally spaced-apart relation (as used herein, the term "longitudinally" denotes the axis defined by the overall movement of ions along ion channel 132). Devices of this general construction are sometimes referred to in the mass spectrometry art as "stacked-ring ion guides". Each electrode 135 is adapted with an aperture through which ions may pass. The apertures collectively define an ion channel 132, which may be straight or curved, depending on the lateral alignment of the apertures. To improve manufacturability and reduce cost in the shown embodiment all of the electrodes 135 may have identically sized apertures (in contradistinction to the device disclosed in the aforementioned U.S. Pat. No. 6,107,628 to Smith et al., wherein each electrode possesses a uniquely sized aperture). An oscillatory (e.g., radio-frequency) voltage source 210 applies oscillatory voltages to electrodes 135 to thereby generate a field that radially confines ions within ion channel 132. According to a preferred embodiment, each electrode 135 receives an oscillatory voltage that is equal in amplitude and frequency but opposite in phase to the oscillatory voltage applied to the adjacent electrodes. As depicted, electrodes 135 may be divided into a plurality of first electrodes interleaved with a plurality of second electrodes, with the first electrodes receiving an oscillatory voltage that is opposite in phase with respect to the oscillatory voltage applied to the second electrodes. In a typical implementation, the frequency and amplitude of the applied oscillatory voltages to the electrodes are 0.5-1 MHz and 20-400 Vp-p (peak-to-peak), the required amplitude being strongly dependent on frequency. It should be noted that the number of electrodes 135 depicted in the figures has been chosen arbitrarily, and should not be construed to limit the invention to any particular number of electrodes. Typical implementations of an ion transport device having a length of 50 mm will have between 12 and 24 electrodes. Due to the increased inter-electrode spacing near the device exit, an ion transport device constructed in accordance with this embodiment of the invention will generally utilize fewer electrodes relative to the conventional ion funnel device described in U.S. Pat. No. 6,107,628 to Smith et al. and the related publications cited above. The ion transport device 105 shown in FIG. 1 in detail depicted (in rough cross-sectional view) in FIG. 2 of US 2009/0045062.

Figure 2:
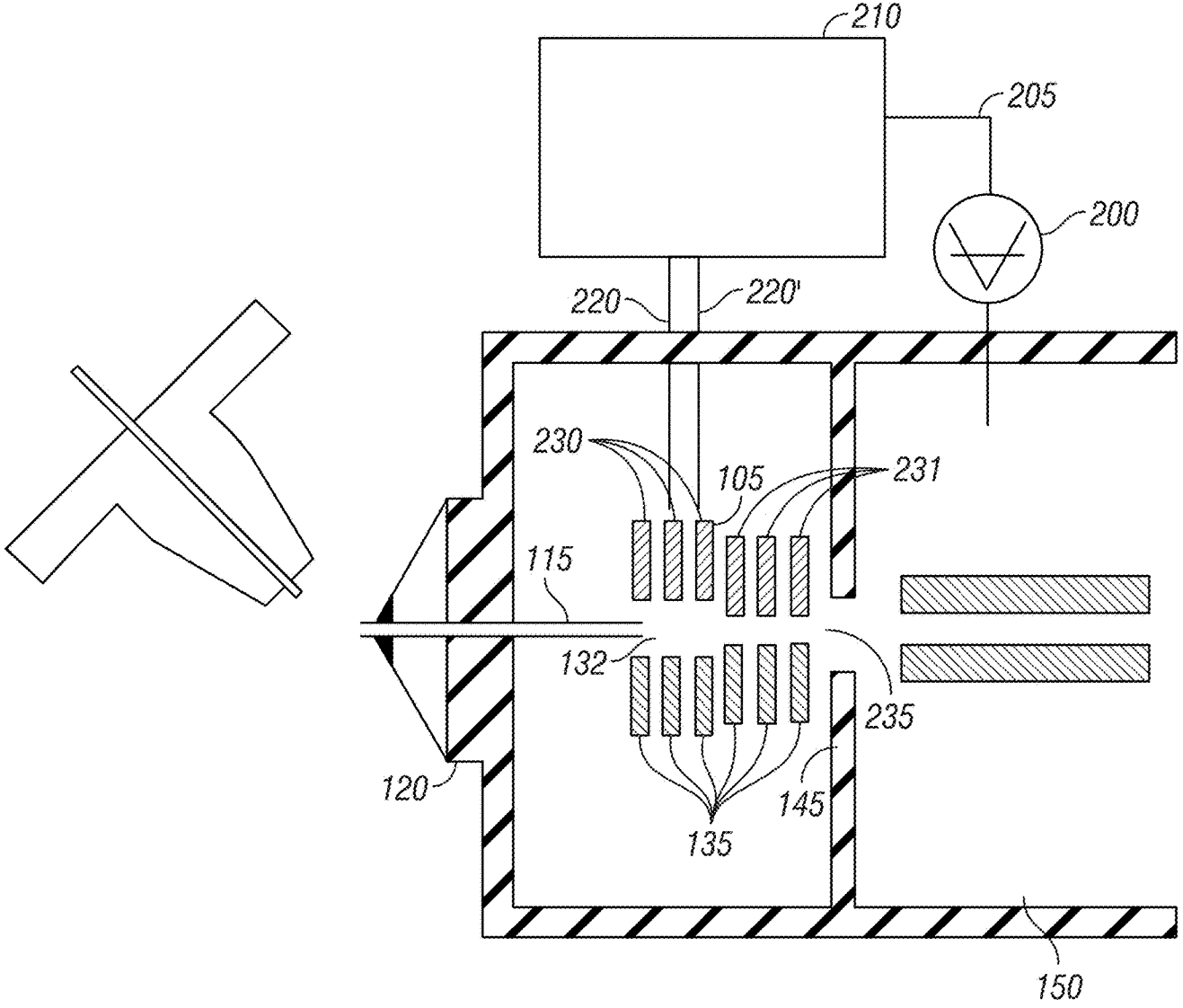
FIG. 2 shows a first embodiment of an ion supply system according to the invention.

In FIG. 2 is now shown an improved ion supply system of a mass spectrometer shown in FIG. 1. In the shown ion supply system, the same reference numbers are used for the same components as in FIG. 1. It is provided an additional vacuum gauge 200, which is measuring the pressure in the vacuum chamber 150, which is typically in a range of 0.05 mbar up to 0.5 mbar, preferably in a range of 0.08 mbar up to 0.3 mbar and particularly preferably in a range of 0.10 mbar up to 0.25 mbar. Ions leaving the ion transport device 105 as narrow focused beam are directed through aperture 140 into the vacuum chamber 150. The pressure signal measured by the pressure gauge 200 is provided by the signal line 205 to a control system 210.

This control system 210 is supplying at least the oscillating voltage to the electrodes 135 of the ion transport device 105 via the supply lines 220 and 220'. For simplicity of the drawing it is not shown how each electrode 135 of the ion transport device 105 is supplied with the oscillating voltage. Details about this are well known be skilled persons and can be found the documents mentioned before about ion transport devices with stacked electrodes. The control system 210 is supplying the oscillatory voltage to the electrodes with an amplitude, which is correlated to the pressure measured by the vacuum gauge 200 in the vacuum chamber 150.

Due to this improved supply of oscillating voltage to the stacked electrodes 135 of the ion transport device 105 the transmission efficiency of the ions supplied by the transfer tube 115 of the ion source can be increased. This is, because to each pressure value measured in the vacuum chamber 150 an optimal amplitude of the oscillating voltage can be correlated to achieve the maximum transmission efficiency of the ions, which shall be investigated.

The invention can be applied to all known ion transport devices with stacked electrodes, to which an oscillatory voltage has to be applied. This can be an ion transport device shown in FIG. 1 and also an ion transport device shown in FIG. 2.

The ion transport device 105 is constructed from a plurality of apertured electrodes 135 that are grouped into a first electrode set 230 positioned adjacent to device entrance, and a second set of electrodes 231 positioned adjacent to device exit 235. First electrode set 230 has apertures that are greater in size relative to apertures of second electrode set 231. Ions are introduced to the entrance via an ion transfer tube 115. In both sets of electrodes 231, 232 the spacing of adjacent electrodes is increased in the direction of the ion travel to focus the ions into the center of the ion channel 132 given by the aperture of the electrodes according teaching of the US patent US 2009/0045062 A1.

In another embodiment the ion transfer tube 115 may have an outlet that is laterally offset with respect to the center of aperture of the initial electrode of first electrode set 231. Ion transfer tube 115, or a terminal segment thereof, then has a central flow axis that is angularly offset (typically by about 5°) with respect to the central flow axis defined by the centers of apertures of the first electrode set 230.

In another not shown embodiment of the ion transport device 105, the centers of the apertures of second electrode set 231 may be laterally offset with respect to each other and the centers of apertures of the first electrode set 230, such that no line-of-sight path exists between the outlet of ion transfer tube 115 and the central aperture of exit lens 145. In this manner, analyte ions must follow an arcuate path to traverse the length of ion transport device and pass through the lens aperture of the extraction lens 145.

Figure 3:
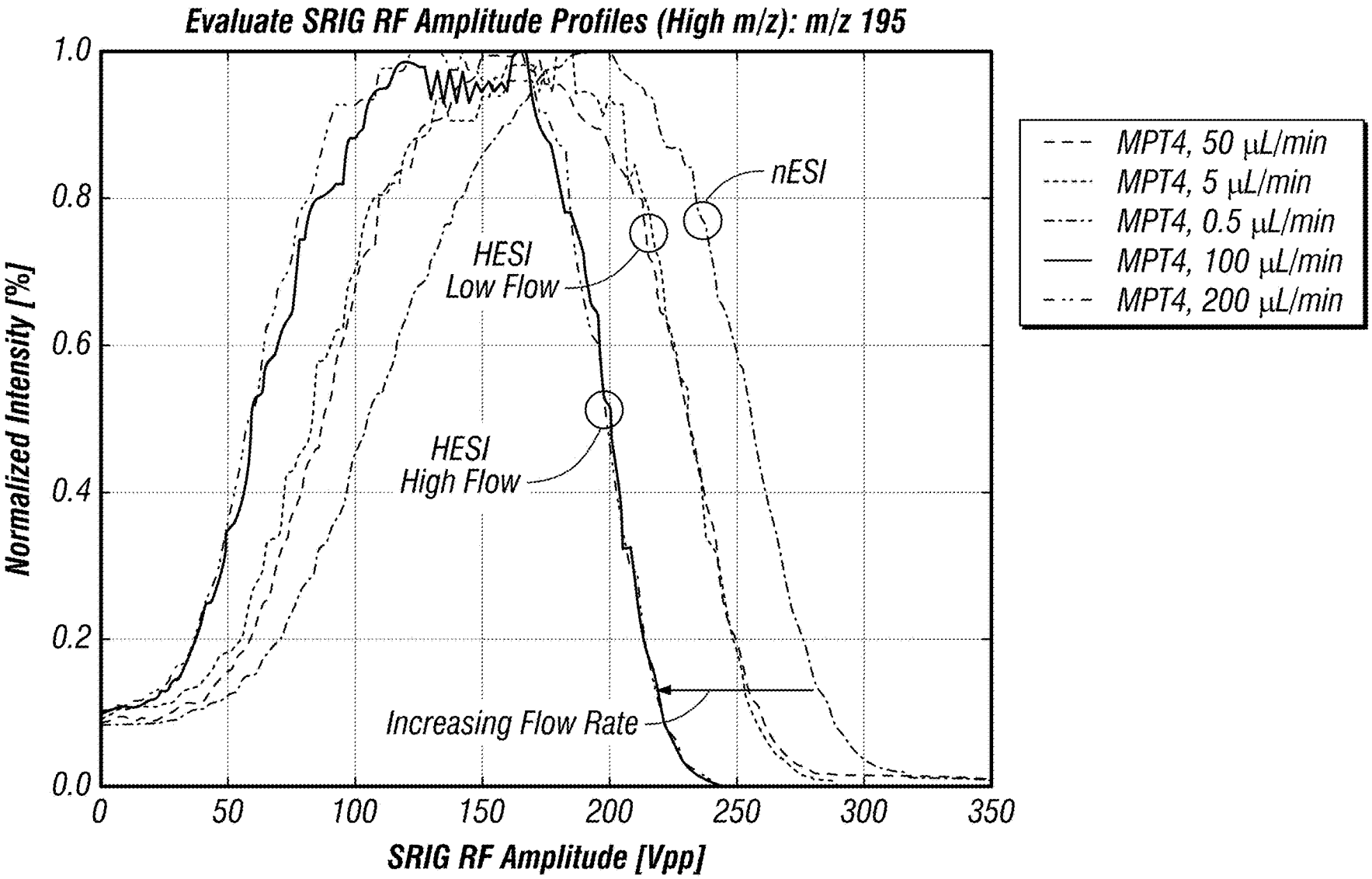
FIG. 3 shows the measurement of the ion transmission of a specific ion supplied by different ion sources.

In FIG. 3 the transmission of ions of a specific mass to charge ratio m/z of the ion transport device 105 is shown, when in the ion supply system of FIG. 2 ions of different ion sources are supplied with different ion flow rates and temperatures to the ion transport device 105.

In Table 1 of FIG. 6 the detailed parameters of the different experiments are shown. Two type of ion sources have been investigated using the ionization methods nano-electrospray ionization (nESI) and heated electrospray ionization (HEST). Different ion flow rates through the ion transfer tube 115 have been applied and different ion temperatures, resulting from different source gas temperatures in the electrospray probe 110. Also in table 1 is shown for each experiment the pressure, which was detected in the vacuum chamber 150 by the vacuum gauge 200.

In FIG. 3 the transmission of ions of a specific mass to charge ratio m/z is shown, which is m/z=195. Only these ions have been detected by the mass analyzer 165 of a mass spectrometer equipped with an ion supply system according to the invention, when only ions of these mass to charge ratio have been filtered by a quadrupole mass filter after passing the ion transport device and before the ions arrive in the mass analyzer. The transmission of the ions has been detected in dependence on the amplitude of the oscillatory voltage, which is in this case a RF voltage, applied to the electrodes of the ion transport device 150.

For each experimental condition a voltage range can be defined, in which a maximum ion transmission is possible. The limits of this range, the flanks of the mass peak in FIG.

3 depend on the experimental conditions. Additional it can be observed that they are nearly equal for certain experiments. The same limits can be found for experiments, when the same pressure has been detected by the pressure gauge 200 in the vacuum chamber 150. So, the limits of the range of oscillating voltages, which can applied to the stacked electrodes of the ion transport device 105 to achieve the transmission of an ion through the ion transport device 105 are correlated to the pressure measured in the vacuum chamber 150. In other words, the minimum and maximum value of the oscillating voltages applied to the stacked electrodes of the ion transport device 105 is correlated with the pressure measured by the pressure gauge 200, which is provided by the invention in the vacuum chamber 150.

So, the correlation of the minimum and maximum value of the oscillating voltages applied to the stacked electrodes of the ion transport device 105 can be detected for different pressure values measured in the vacuum chamber 150, arranged downstream the ion transport device.

Figure 4:
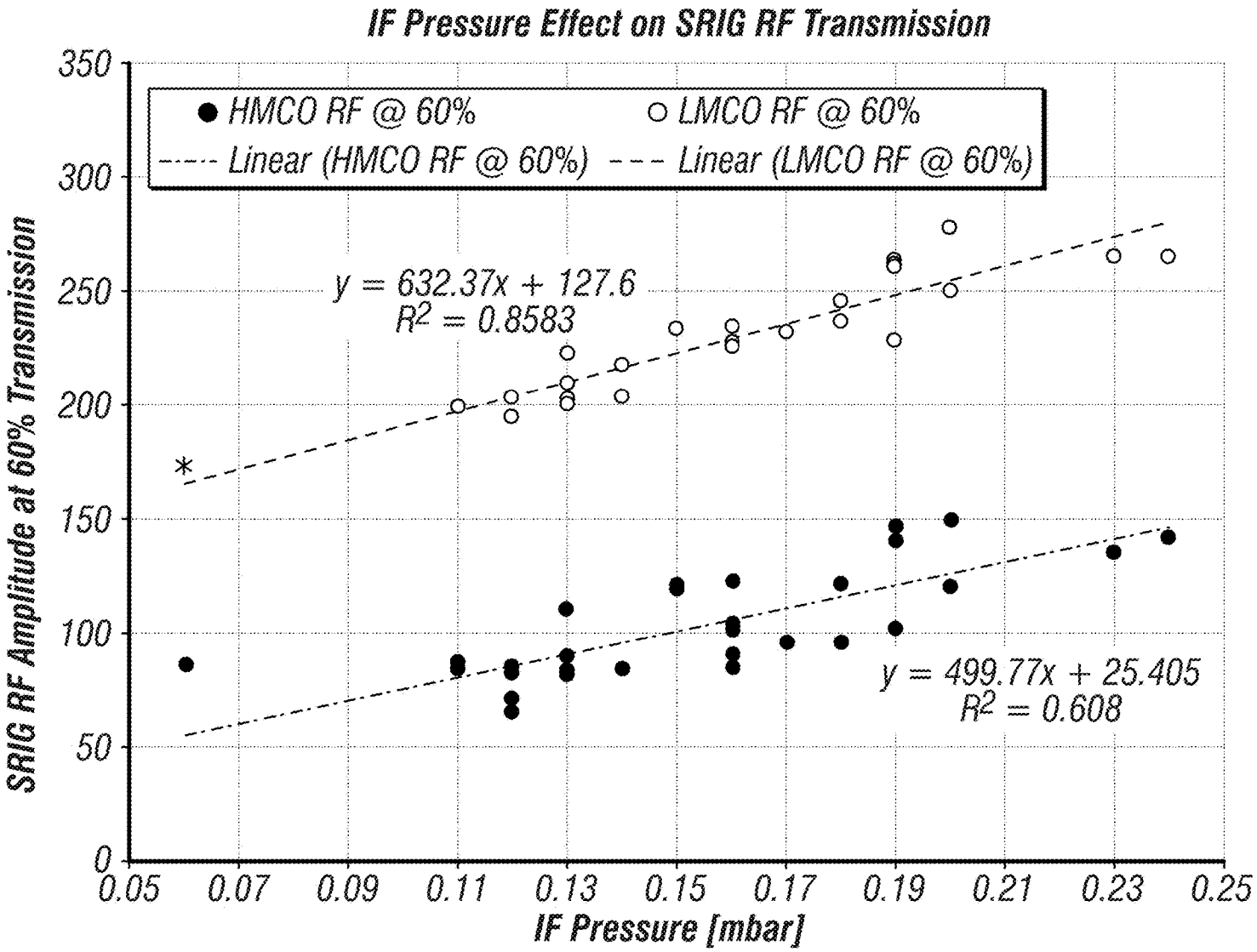
FIG. 4 shows the correlation of the cut off amplitudes of the oscillating voltage supplied to the electrodes of an ion transport device with the pressure in the vacuum chamber downstream from the ion transport device.

Such a correlation of the minimum and maximum value, the low mass cut off value (LMCO) and high mass cut off value (HOMO) of the oscillating voltages applied to the stacked electrodes of the ion transport device 105 with the pressure in the vacuum chamber is shown in FIG. 4. The shown cut off values are defined by that value of the applied RF voltage, when the transmission of the investigated ion has been reduced to 60% of the maximum transmission. As shown in FIG. 4, the correlation of the minimum and maximum value with the measured pressure in the chamber 150 is at least nearly linear. Very often a linear approach can be used to define a calibration curve.

Such a calibration curve correlating the maximum value or minimum value of the oscillating voltages applied to the stacked electrodes of the ion transport device 105 with the pressure in the vacuum chamber 150, in which the ions are transferred, if they have passed the ion transport device, can be determined for each ion supply system or all instruments using such a ion supply system in common.

These calibration curves can be used by the control system 210, which is supplying the oscillating voltage to the electrodes of the ion transport device 105. The control system is receiving the pressure signal of the pressure in the vacuum chamber 150 via the vacuum gauge 200, provided in the vacuum chamber 150. It is advantageous if the vacuum gauge is provided close to the device exit 137, 235 and the extraction lens 145.

If now the pressure gauge 200 is detecting a pressure change in the vacuum chamber 150, the control system can adjust the oscillating voltage to the electrodes of the ion transport device 105 according to the calibration curve. From the calibration curve it can be derived, which change of the supplied oscillating voltage is necessary that a full ion transmission is possible independent on the pressure change. In general, the calibration curve of the maximum value or minimum value of the oscillating voltages applied to the stacked electrodes of the ion transport device 105 can be used or the mean value of the maximum value or minimum value of the oscillating voltages applied to the stacked electrodes of the ion transport device 105 (the middle) as calibration curve. So, the inventive ion supply system is now flexible to guarantee an ion transmission, in particular an optimized ion transmission, though a pressure change has happened in the vacuum chamber 150, which is correlated with a pressure change in the ion channel of the ion transport device. In this was there is an online correction of the oscillating voltage supplied to the electrodes of the ion transport device 105 for the first time possible.

Origin of possible pressure changes can be a clogging in the ion inlet device, e.g. in the ion transfer tube 115 or an intentional or unintentional change of the experimental setup, e.g. changes of temperature of the sample, the temperature of the ion inlet device, the setting of the ion source, the orientation or shape of the ion inlet device, the sample flow or the ion flow.

A calibration curve might be defined for one specific mass to charge ratio and then applied to all pressure changes. It can also be defined for several ions of specific mass to charge ratio. Then the medium slope of all calibration curves can be used for the correction of the oscillating voltage supplied to the electrodes of the ion transport device 105 due to pressure change.

It has been described how the oscillating voltage supplied to the electrodes of the ion transport device 105 can be adapted to a pressure change in the vacuum chamber 150. If the used calibration curve has been determined for an ion supply system in common, this calibration curve can be adapted to each individual device e.g. by measuring the ion transmission according to FIG. 3 one time of ions of the mass to charge for which the calibration curve is determined at a specific pressure value $p_0$. If the detected maximum value or minimum value of the oscillating voltages applied to the stacked electrodes of the ion transport device 105 does not fit with the common calibration curve, then the individual calibration curve of the individual ion supply device can be defined by adding to the common calibration curve the difference between the detected maximum value or minimum value and the maximum value or minimum value of the common calibration curve at the pressure $p_0$. Then this individual calibration curve can be used by the control system 210 to adapt the oscillating voltage supplied to the electrodes of the ion transport device 105 based on the pressure measured by the pressure gauge 200 in the vacuum chamber. This adaptation is now related to the measured pressure and not a measured pressure change. So now the control unit is able to correct the supplied oscillatory voltage directly, when after the start of an experiment it is detected by the pressure gauge 200, that the pressure in the chamber 150 deviates from the pressure expected for the experiment.

In general, it is to say, that the detection of the pressure in the vacuum chamber 150, in which the ions move directly after they have passed the ion transport device 150 makes it possible, that always the appropriate oscillating voltage is applied to the stacked electrodes 135 of the ion transport guide resulting in an improved ion transmission of the ion transport device 105.

Figure 5:
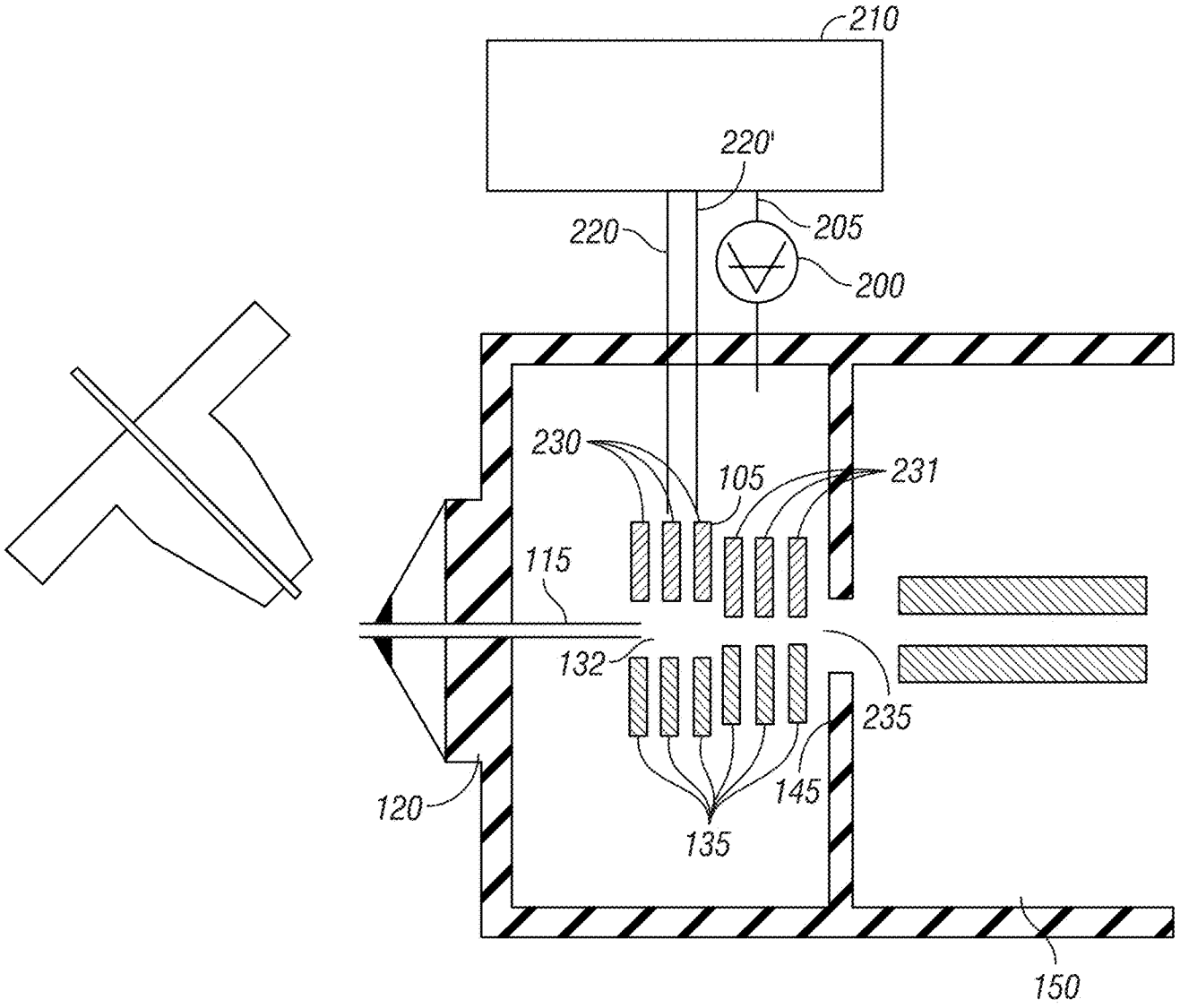
FIG. 5 shows another embodiment of an ion supply system according to the invention.

In FIG. 5 is shown another embodiment of the invention, which is also solving the problem addressed before. The only difference between the ion supply systems of the FIGS. 2 and 5 is, that in the vacuum gauge 200 is now not arranged in the vacuum chamber 150 downstream of the ion transport device. The vacuum gauge 200 is now arranged in the fore vacuum chamber 130. Also in the embodiment the pressure signal 205, detected by the vacuum gauge is supplied to the control system 210 supplying the oscillatory voltage to the electrodes of the ion transport device. But with this further solution the improvement of the ion transmission of an ion transport device is limited compared to the embodiment, when the pressure is detected in the vacuum chamber 150 downstream of the ion transport device.

The invention claimed is:

1. An ion supply system, comprising:

an ion source emitting ions into a fore vacuum chamber;

an ion transport device having stacked electrodes arranged in the fore vacuum chamber;

a control system supplying a oscillatory voltage to the electrodes of the ion transport device; and a vacuum chamber, arranged downstream from the ion transport device, in which a vacuum gauge is arranged, the vacuum gauge generating a pressure signal representative of a measured pressure;

wherein the pressure signal is supplied to the control system supplying the oscillatory voltage, and the control system is configured to set an amplitude of the oscillatory voltage in accordance with a known correlation between a pressure in the vacuum chamber and an amplitude range for optimized ion transmission.

2. The ion supply system of claim 1, wherein the amplitude of the oscillatory voltage supplied by the control system to the electrodes of the ion transport device is changed when a change of pressure is detected by the vacuum gauge.

3. The ion supply system of claim 2, wherein the control system is configured to change the amplitude of the oscillatory voltage supplied by the control system to the electrodes of the ion transport device according to a calibration curve relating the pressure signal and the amplitude.

4. The ion supply system of claim 1, wherein the vacuum gauge is arranged in the vacuum chamber close to a device exit of the ion transport device.

5. The ion supply system of claim 1, wherein the vacuum gauge is arranged in the vacuum chamber close to a lens aperture of an extraction lens downstream from the ion transport device, which is arranged between the fore vacuum chamber and the vacuum chamber.

6. The ion supply system of claim 1, wherein the spacing of adjacent electrodes of the ion transport device is increased in the direction of the ion travel.

7. The ion supply system of claim 1, wherein the electrodes of the ion transport device are grouped into a first electrode set positioned adjacent to a device entrance, and a second set of electrodes positioned adjacent to a device exit, and the electrodes of the first electrode set have apertures that are greater in size relative to apertures of electrodes of the second electrode set.

8. The ion supply system of claim 1, wherein the electrodes of the ion transport device have apertures that decrease in size from an entrance of the ion transport device to an exit of the ion transport device.

9. An ion supply system, comprising:

an ion source emitting ions into a fore vacuum chamber;

an ion transport device having stacked electrodes arranged in the fore vacuum chamber;

a control system supplying an oscillatory voltage to the electrodes of the ion transport device; and a vacuum chamber, arranged downstream from the ion transport device;

wherein a vacuum gauge is arranged in the fore vacuum chamber and wherein the pressure signal of the vacuum gauge representative of a pressure measured by the vacuum gauge is supplied to the control system supplying the oscillatory voltage, and the control system adjusts an amplitude of the oscillatory voltage in accordance with a known correlation between a pressure in the vacuum chamber and an amplitude range for optimized ion transmission.

10. Method for supplying ions into a vacuum system, comprising the steps:

(i) creating ions in an ion source;

(ii) emitting the ions into an ion channel of an ion transport device having stacked electrodes, which is arranged in a fore vacuum chamber;

(iii) applying an oscillation voltage to the electrodes of the ion transport device, so that the ions travelling through the ion transport device are radial confined to an aperture arranged behind the ion transport device, through which they travel into a vacuum chamber;

(iv) measuring with a vacuum gauge the pressure in the vacuum chamber downstream of the ion transport device; and (v) submitting a pressure signal of the vacuum gauge to a control unit, controlling at least the oscillation voltage applied to the electrodes of the ion transport device, wherein the control unit is applying an oscillation voltage to the electrodes, which is correlated to the pressure measured in the vacuum chamber.

* * * * *